US006450174B2

(12) United States Patent
Mulaisho

(10) Patent No.: US 6,450,174 B2
(45) Date of Patent: Sep. 17, 2002

(54) DEVICE FOR FACILITATING MANICURING AND METHOD OF USE THEREOF

(76) Inventor: Patrick Njauwa Mulaisho, 16B Basement Flat, Addison Avenue, Holland Park, London W11 4QR (GB)

( * ) Notice: Subject to any disclaimer, the term of this patent is extended or adjusted under 35 U.S.C. 154(b) by 0 days.

(21) Appl. No.: 09/942,775

(22) Filed: Aug. 31, 2001

Related U.S. Application Data

(63) Continuation of application No. 09/242,669, filed as application No. PCT/GB97/02229 on Aug. 20, 1997, now abandoned.

(30) Foreign Application Priority Data

Aug. 20, 1996 (ZM) ..... 26/96

(51) Int. Cl.[7] ..... A45D 29/00; A45D 29/18

(52) U.S. Cl. ..... 132/73; 132/73.5; 132/76.4

(58) Field of Search ..... 132/73, 73.5, 75.6, 132/76.4

*Primary Examiner*—John J. Wilson
*Assistant Examiner*—Robyn Kieu Doan
(74) *Attorney, Agent, or Firm*—Dykema Gossett PLLC

(57) ABSTRACT

A portable finger locating and supporting device for use during manicuring having an elongated body shaped and dimensioned to be held comfortably between the fingers and palm of one hand. The ends fo the fingers pass around a corner portion of the body which extends along the length thereof. The body has a series of spaced recesses extending around the corner portion for receiving respective fingers of the hand to locate and support the fingers separated from one another.

8 Claims, 5 Drawing Sheets

DEVICE FOR FACILITATING MANICURING AND METHOD OF USE THEREOF

This application is a continuation of Ser. No. 09/242,669 filed Feb. 22, 1999 abandoned which is a 371 of PCT/GB97/02229 filed Aug. 20, 1997.

The present invention relates to devices for facilitating manicuring and to methods of using such devices.

Nail manicuring is an age-long nail treatment procedure including such chores as nail-cropping, nail-filing, finger-nail varnishing, nail-massaging and application of false nails over (and mostly longer than) the natural nails, and is particularly associated with, but not solely restricted to, females' beauty science. Hitherto, nail manicuring chores have been performed with or without a support or a finger steadier for steadying fingers while the nail fixing is in progress.

During unsupported finger manicuring, all fingers of the hand needing attention are normally either stretched out or clasped together in a loose fist with the thumb either resting full length across the fore-finger or bentsubmerged under the fore-finger. The shortcoming of either of these finger positioning postures is that, due to absence of a support to steady them, the fingers can be rather shaky which results in the nail manicuring chore being less precise. This increases the occurrence of unnecessary smearing of nail-surrounding skin in the case of nail varnishing, or otherwise causes greater difficulty of applying precise nail manicuring attention exclusively to the nail area only of a particular finger.

In the case of posing the hand with outstretched fingers (and less so, perhaps, of the thumb) an additional practical difficulty is presented due to the fact that, when held in such a position, the fingers can be at an awkward angle, which, unless the nail manicuring chore is being executed by a person other than the palm owner, renders precision nail manicuring more difficult. It is further observed in this relation that leverage with or amongst the fingers is inhibited by the limited view of each nail surface and this in turn compels the palm owner to move the hand around until each nail surface is in a clearer view to the owner.

Furthermore, as the thumb nail lies on a plane which is substantially perpendicular to the one common plane in which nails of the rest of the fingers lie, the palm owner is again compelled to tilt the relevant palm to bring the thumb nail face up in order to successively manicure it, which may result in disturbing the nails already manicured. In attempting to steady finger nails and generally enhance precision in any nail manicuring chore, it is common practice for the manicurer to lay the hand palm down on a flat surface with the fingers and thumb outstretched but this is disadvantaged by the "awkward angle" which inhibits view of each finger's nail area, and by the compulsion to tilt the palm for raising the thumb nail into a clearer upper view.

In fact the laying of fingers on a flat surface is one of the time-wasting rituals of current nail manicuring chores wherein, for convenience the palm owner's thigh acts as the flat surface, in which case the palm owner will normally precede the manicuring chore with other similarly time-wasting rituals such as placing a small piece of cloth on the thigh to avoid staining the fabric of the palm owner's skirt or trouser leg. In such nail manicuring methods, however, cloth fabric-staining accidents are very palpable occurrences, which can never be ruled out.

According with one aspect of the present invention, whose scope is defined in the appended claims, there is provided a finger locating an supporting device for facilitating manicuring, comprising a first elongated face in which are formed a plurality of recesses, the device, in use, being gripped in a hand such that at least the tip of at least one of the fingers of the hand is positioned in one of said recesses, whereby the or each finger is steadily presented for manicuring.

According to another aspect of the present invention there is provided a method of manicuring using the device of the invention comprising the steps of gripping the device in the hand to be manicured with at least the end of at least one of the fingers of the hand lying in one of the recesses, and manicuring the or each finger.

Stated more specifically the invention provides a portable finger locating and supporting device for use during manicuring comprising an elongate body shaped and dimensioned to be held comfortably between the fingers and palm of one hand, with the ends of the fingers passing around a corner portion of the body which extends along the length thereof, said body having a series of spaced recesses extending around said corner portion for receiving respective fingers of the hand to locate and support the fingers separated from one another.

A device for facilitating manicuring and a method of manicuring using such a device in accordance with the invention has the advantage of saving time by making obsolete the ritual of finding a flat surface and of clothing or dressing the surface (if using the thigh as the flat surface). Associated to this, there is also no longer the chance of soiling fabric of the palm owner's skirt or trouser leg.

In addition, when the device is gripped in the palm with the or each finger positioned in a recess, each finger nail is positioned in a manner which ensures maximum exposure of each individual finger nail, thereby necessitating only the most minimal movement. The device is also preferably sized to fit easily into a handbag or pocket.

In an advantageous development of the invention, the thumb of the hand is positioned in a recess formed in one end surface of the device such that the thumb nail is elevated in a manner which secures maximum surface area exposure of the nail involving the most minimal movement of the wrist. In that way the problem of having to tilt the hand to bring either the fingers planetary line or that of the thumb (as the case may be) to a horizontal position, is also eliminated.

In a preferred embodiment of the invention, the device is provided with two sets of mirror imaged recesses such that it can be used for either the left or the right hand.

In order that the invention may be well understood, there will now be described an embodiment thereof, given by way of example, reference being made to the accompanying drawings in which.

Figure 1:
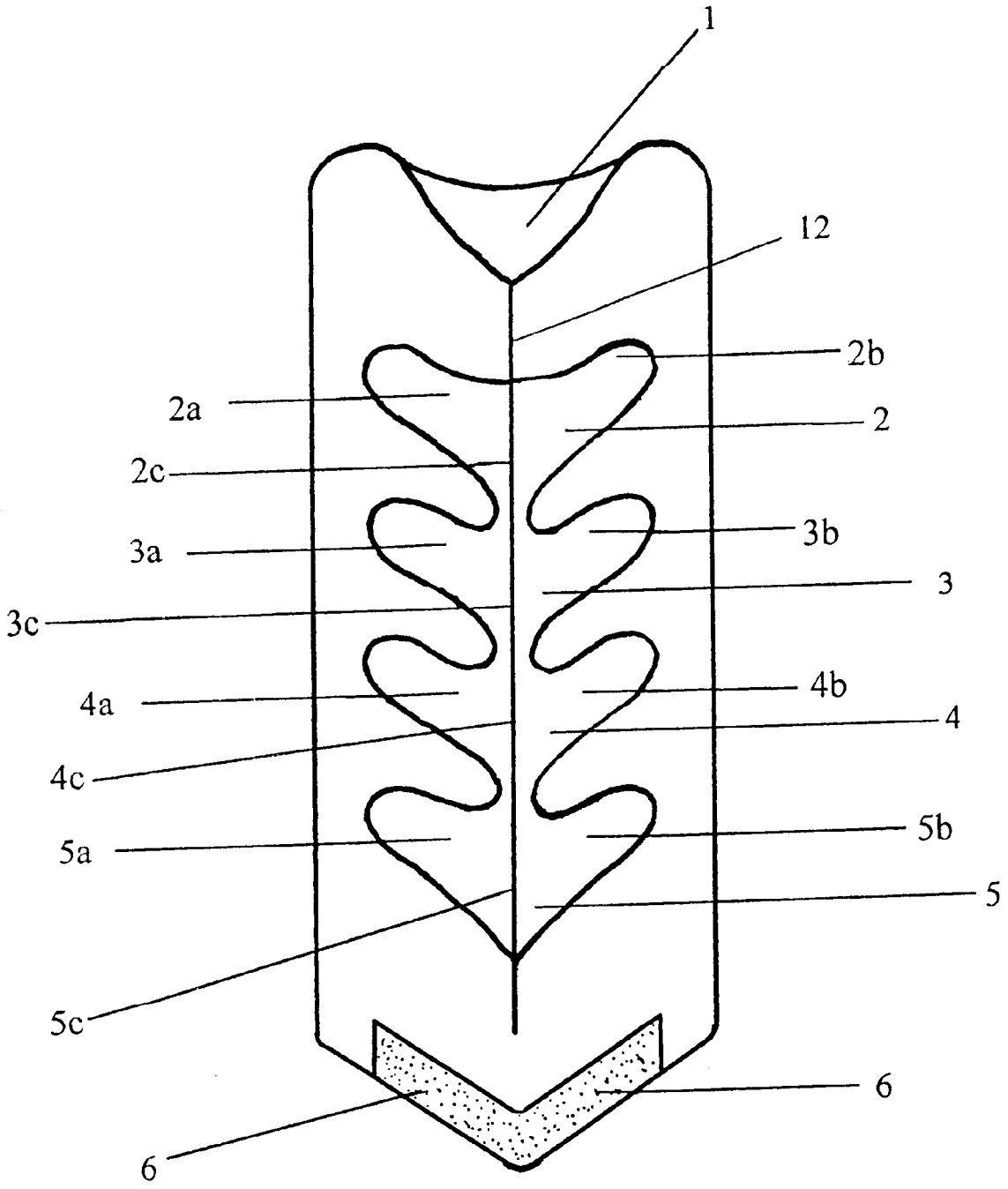
FIG. 1 is a front view of a device for facilitating manicuring showing grooves into which fingers may be positioned, a groove on an end face in which the thumb may be rested, and a small nail file along the foot of the device.

Referring now in greater detail to the drawings, in which like reference numerals consistently designate like parts of the invention operating in a like manner in all the drawings, there is shown a device for facilitating manicuring. Although the size and general configuration of the device have no restriction, it is preferred (as herein described) that the length and diameter of the main body of the device are such as to make it amenable to convenient handling in a palm and that the general configuration should preferably be in a triangular shape.

Figure 2:
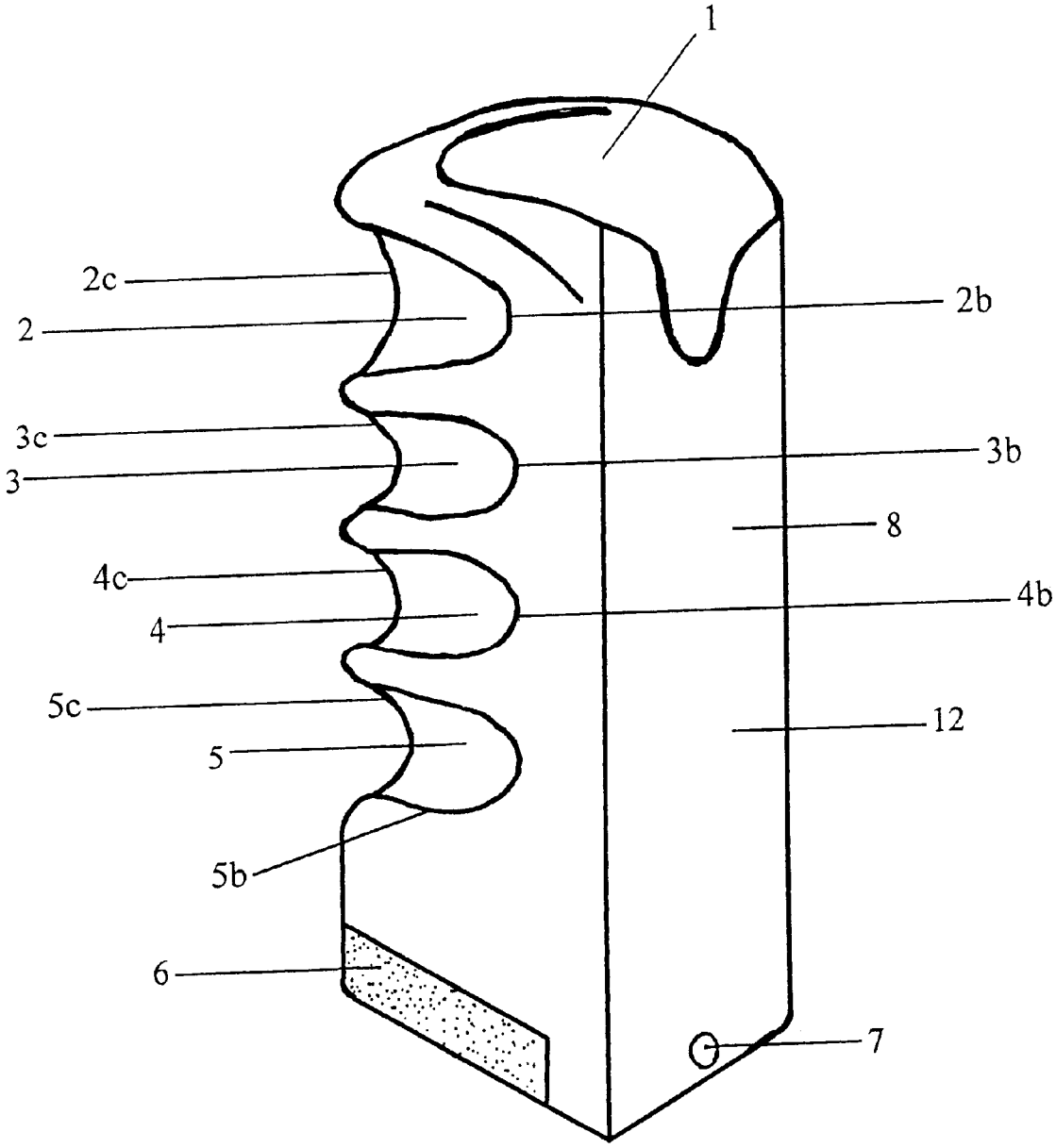
FIG. 2 is a perspective view from the left of the device of the invention, showing a left wing of finger grooves, the thumb groove at the apex and the left-part of the file at the foot of the elevation.
Figure 3:
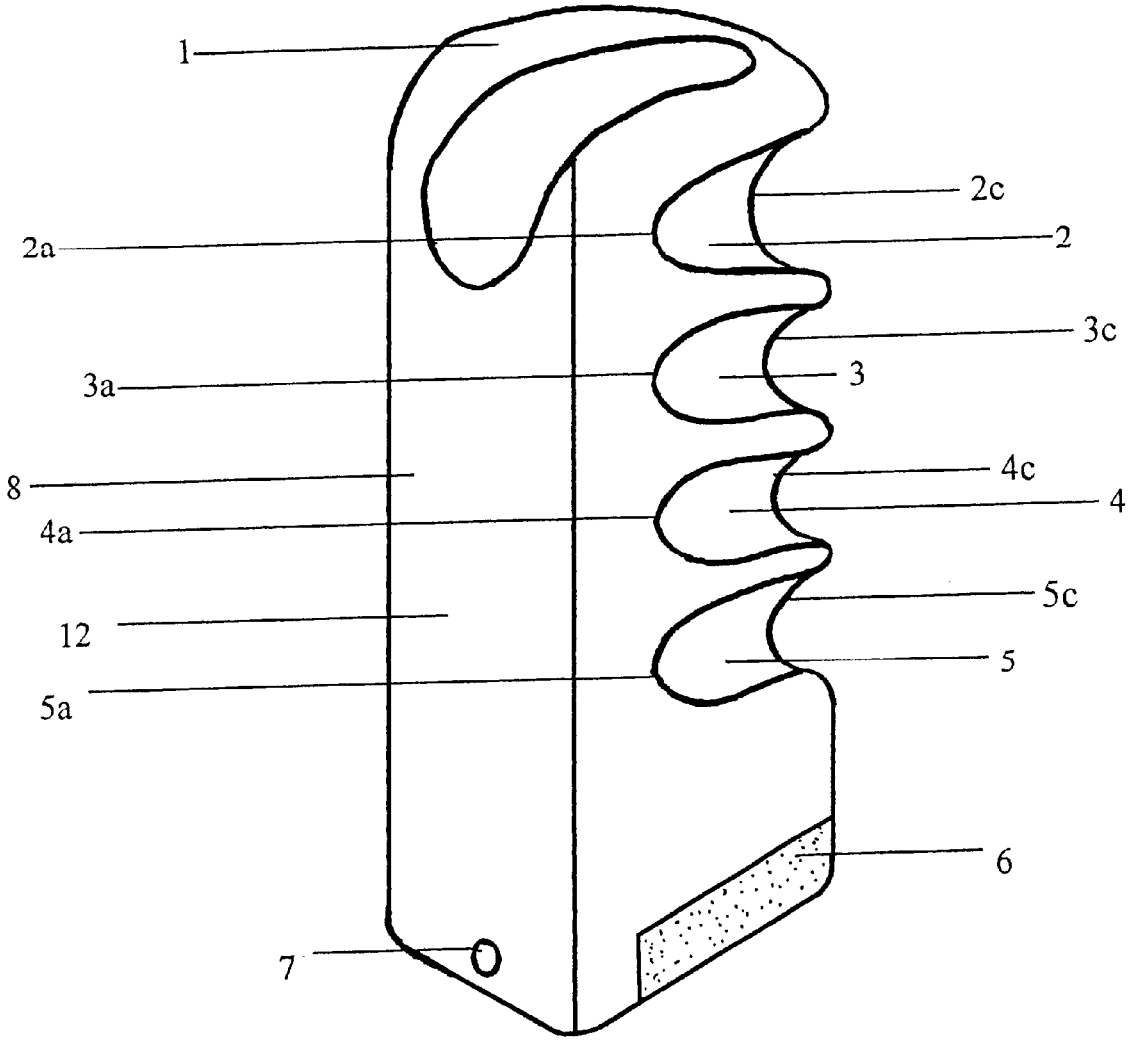
FIG. 3 is a perspective view from the right of the device of the invention showing a night wing of the finger grooves, the thumb groove at the apex of the device and the right wing of the nail file.

Referring first to FIG. 1, there is shown a device in front view having a detachable nail file 6 carried on the foot of the device, groove I that begins at the apex and slants down (as side views in FIGS. 2 and 3 show) at the back to taper off slightly below the curve of the device's head, and additional grooves 2 to 5.

Although grooves 2 to 5 differ slightly from each other in size to suit the size of the respective human fingers which they are intended to receive (e.g. groove 5 which is meant to receive the smallest finger of the palm may in practice be smaller than groove 3 that receives houses the tallest middle finger), what is described of groove 2 as follows is true of grooves 3, 4 and 5.

As FIG. 1 shows, groove 2 is wing shaped such that the line 2*c* that bisects it into two wings lies both at the deepest portion of each wing 2*a*,2*b* and along the line of symmetry between the two wings 2*a* and 2*b* (either of which lies on, respectively, the left side and right side of the middle 2*c* of the groove). Each wind tapers in depth while it moves away to the side from 2*c*. In this figure, 12 is an imaginary line which runs symmetrically through one of the three corners of the device, bisects groove 1 along its length and runs down the back of the device and through sharpener hole 7 (see FIG. 3). In FIG. 1 then the middle 2*c*, 3*c*, 4*c* and 5*c* of grooves 2, 3, 4 and 5 (see FIG. 4) lie along the edge which symmetry line 12 also traverses.

To enhance their features as represented in FIG. 1 these parts can be seen in side views denoted in FIGS. 2 and 3. Thus, FIG. 2 (which shows the right side elevation) contains the device's back-surface 8 down which symmetrical line 12 continues to run to cut right through sharpener hole 7 on way to the base. As denoted in FIG. 1 both the symmetry line 12 and edge 14 run from foot through 5*c*, 4*c*, 3*c* and 2*c*. In this figure only 2*b*, 3*b*, 4*b* and 5*b* (being right wings of grooves 2,3,4, and 5 respectively) are in view in addition to groove 1. Only a part of the nail appears in this elevation.

Furthermore, the invention as presented by FIG. 3 (which gives the left view of the device) is closely similar to the view in FIG. 2 except that FIG. 3 presents as noted the left wings (2*c*, 3*c* 4*c* and 5*c*) of the grooves 2, 3, 4 and 5 respectively and of the nail file 6.

Figure 4:
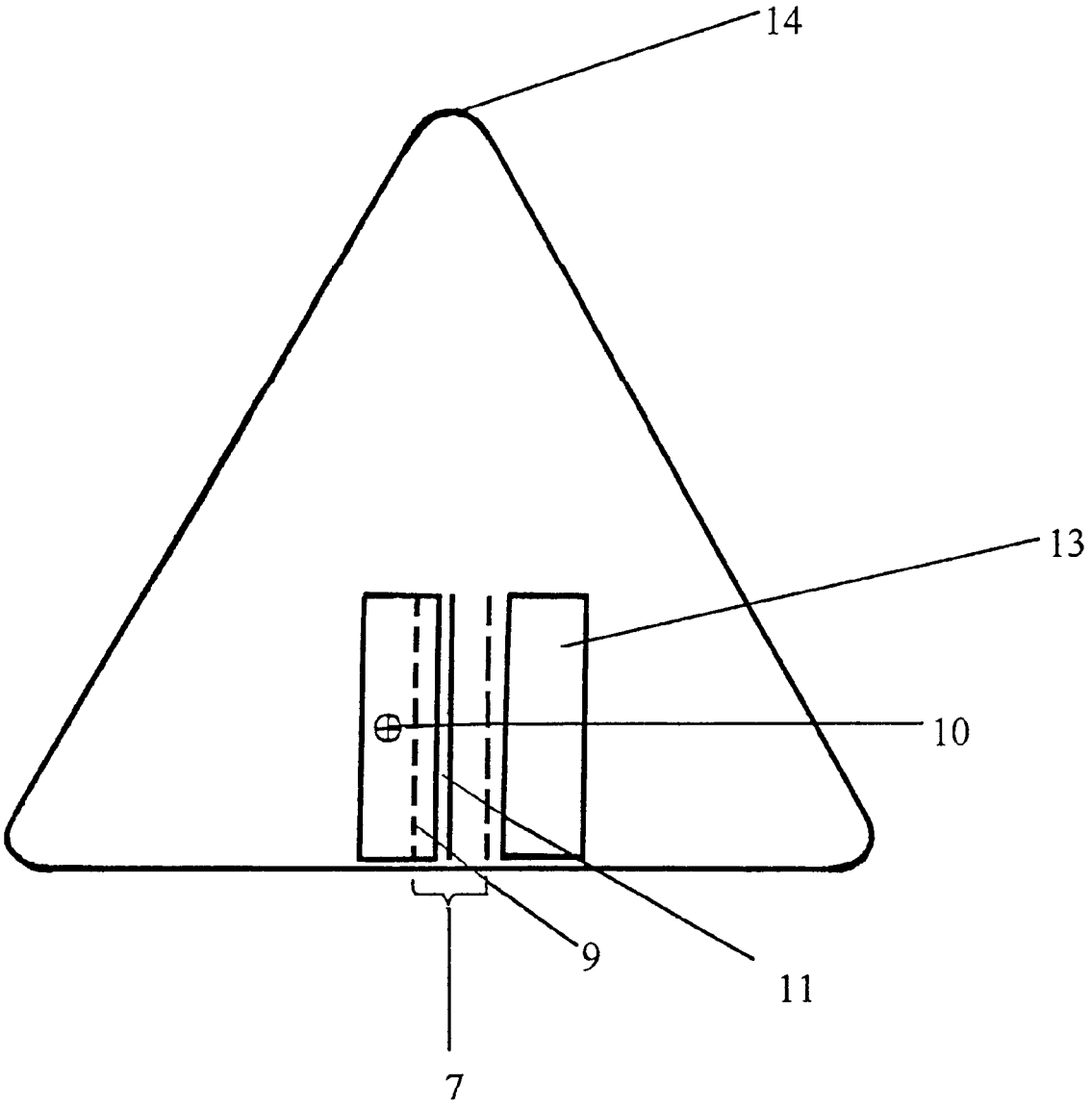
FIG. 4 is the bottom view of the device of the invention.

In addition to the detachable nail file 6, there is further provided a pencil sharpener consisting of an active blade 9, a spare blade 13 and a sharpener hole 7 (see FIG. 4). While blade 9 (which is fastened to the device by means of a screw 10) and the spare blade 13 are attachments to the bottom of the shaft of the device, the sharpener hole 7 enters the shaft at the tool of the side directly opposite edge 14 such that when active blade 9 is in place, it covers only about ¾ or so of the hollow space by which hole 7 opens out to the base. This in practice leaves about ¼ space of the length of the hole 7 running along (and next to) the sharpened edge of the blade 9 such that waste scrapped from a mascara pencil or indeed any writing or makeup device requiring sharpening escapes through space 11.

In order to preserve its advantage of light-portability, the device should be made or constructed from preferably light material such as (virgin) plastic, paper-mache or similar featherweight material. This light-portability may further be enhanced by forming the device's shaft with a hollow-core running along its in-side length. This hollow-core structure, with the outward grooves and sharpener, can be produced either by making two separate parts (left and right sections) and bonding them along the symmetrical line 12 or by a blow moulding process wherein a cylindrical mould having walls shaped like the invention in inverted form receives a tubular plastic parison or input cut to the convenient size of the mold. Then compressed air is blown into the tubular input to inflate its sides hardpressed against the grooved walls of the mould. The device is substantially rigid in construction.

Figure 5:
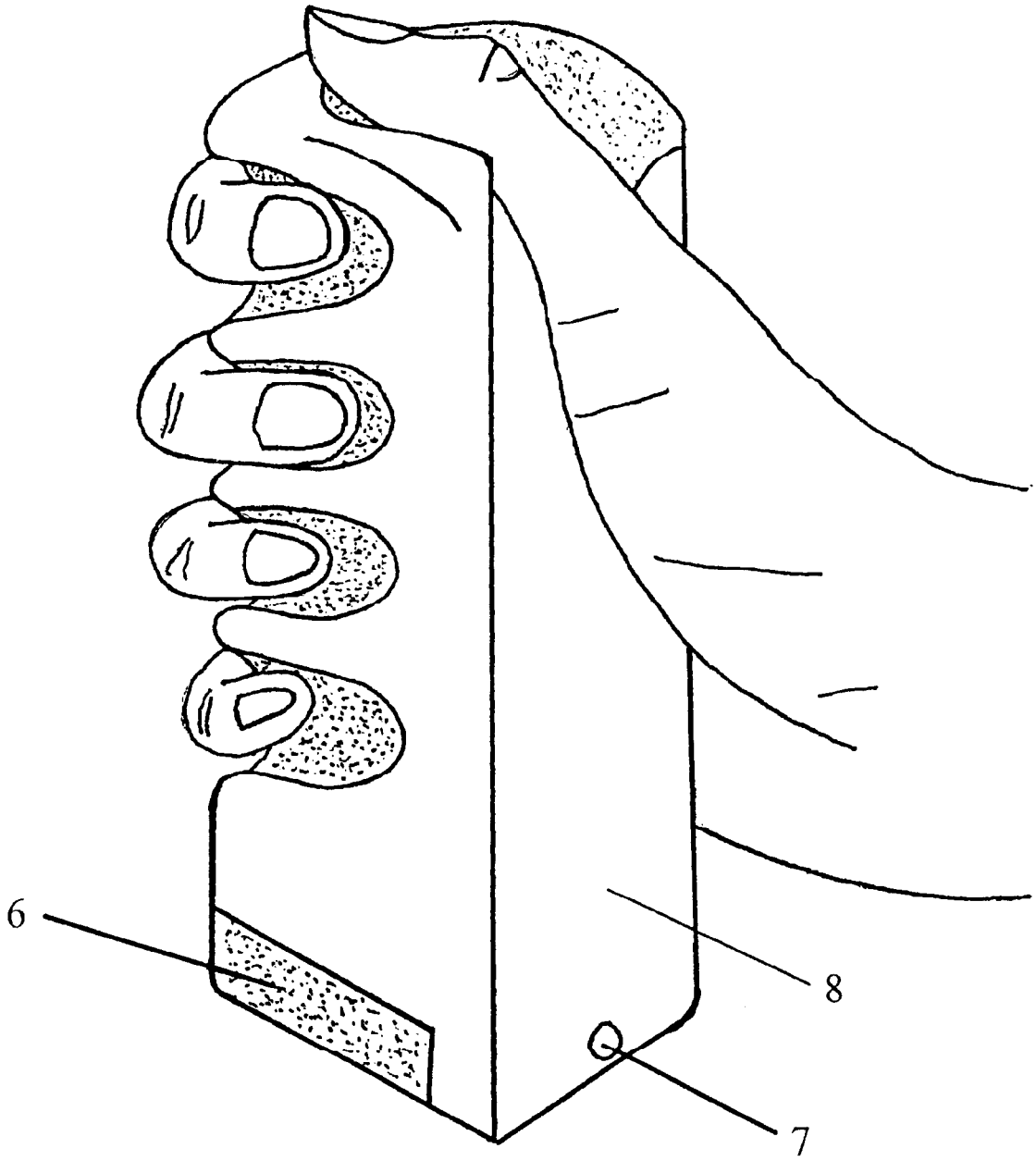
FIG. 5 is a perspective view of the device of the invention grasped in a right hand which it is intended should be manicured.

In use, the user clasps the device (by the palm needing nail manicuring) as shown in FIG. 5 such that while the thumb rests in groove 1 in an upward pointing position, groove 2 will house the index finger, groove 3 will then house the middle tall finger, groove 4 will similarly house the second last finger, while groove 5 will house the last (smallest) finger. While fingers are in this resting steady position they are now more amenable to better nail manicuring because they do not easily move unintentionally. This position also reduces the possibility of stained skin around the nail.

What is claimed is:

1. A device for facilitating manicures, comprising:

an elongated body having a first face surface, a second face surface and a back surface, said surfaces defining a substantially triangular shaped cross-section;

a plurality of grooves formed in said first face surface and said second face surface, said grooves in said first face surface being a mirror image to said grooves in said second face surface, said grooves facilitating the placement of the fingers of a person using said device; and a top surface with a top groove formed therein for facilitating placement of a thumb therein, a portion of said top groove extending to and being formed in said back surface of the device;

wherein a user grasps said body of said device between their fingers and the palm of their hand with the fingers extending around and locating within the grooves on said first and said second face surfaces of said device while the palm of their hand grips said back surface of said device and the thumb is placed within said top groove of said device thereby placing the hand in a position to be manicured.

2. A device as claimed in claim 1, wherein the grooves in said first face surface and said second face surface are arranged in a fish bone pattern.

3. A device as claimed in claim 1, wherein said first face surface and said second face surface meet at a first edge of the device, said grooves formed in said first and/or said second face surface extending away from said first edge.

4. A device as claimed in claim 1, wherein a sharpener is housed within said body for sharpening manicuring accessories.

5. A device as claimed in claim 1, wherein a nail file is removeably attached to the body of the device.

6. A device as claimed in claim 1, wherein the nail file is attached to said first and second face surfaces.

7. A device as claimed in claim 1, wherein the core of the body is hollow.

8. A device for facilitating manicures, comprising an elongated body having a first face surface, a second face surface and a back surface, said surfaces defining a substantially triangular shaped cross-section, said body having a sharpener housed therein, said sharpener for sharpening accessories;

a plurality of grooves formed in said first face surface and said second face surface, said grooves in said first face surface being a mirror image to said grooves in said second face surface, said grooves facilitating the placement of the fingers of a person using said device;

said back surface having a hole for allowing access to said sharpener;

a top surface with a top groove formed therein for facilitating placement of a thumb therein, a portion of said top groove extending to and being formed in said back surface of the device;

a bottom surface having a screw therein for retaining said sharpener within said body; and a nail file removably attached to said first and second face surfaces, said mail file to be used to file nails;

wherein a user grasps said body of said device between their fingers and the palm of their hand with the fingers being placed within the grooves on said first and said second face surfaces of said device while the palm of their hand grips said back surface of said device and the thumb is placed within said top groove of said device thereby placing the hand in a position to be manicured.

* * * * *